US010113132B2

(12) United States Patent
Zhang

(10) Patent No.: US 10,113,132 B2
(45) Date of Patent: Oct. 30, 2018

(54) COUPLED PHENOLS FOR USE IN BIODIESEL ENGINES

(71) Applicant: The Lubrizol Corporation, Wickliffe, OH (US)

(72) Inventor: Yanshi Zhang, Solon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 50 days.

(21) Appl. No.: 14/443,182

(22) PCT Filed: Oct. 31, 2013

(86) PCT No.: PCT/US2013/067637

§ 371 (c)(1),
(2) Date: May 15, 2015

(87) PCT Pub. No.: WO2014/078083

PCT Pub. Date: May 22, 2014

(65) Prior Publication Data

US 2015/0307803 A1 Oct. 29, 2015

Related U.S. Application Data

(60) Provisional application No. 61/727,936, filed on Nov. 19, 2012.

(51) Int. Cl.

| | |
|---|---|
| ***C07F 5/04*** | (2006.01) |
| ***C10L 1/22*** | (2006.01) |
| ***C10M 159/22*** | (2006.01) |
| ***C10L 1/18*** | (2006.01) |
| ***C10M 141/08*** | (2006.01) |
| ***C10M 141/02*** | (2006.01) |
| ***C10M 145/20*** | (2006.01) |
| ***C10M 163/00*** | (2006.01) |
| ***C10M 129/14*** | (2006.01) |

(52) U.S. Cl.

CPC ..... *C10M 141/08* (2013.01); *C10M 129/14* (2013.01); *C10M 141/02* (2013.01); *C10M 145/20* (2013.01); *C10M 163/00* (2013.01); *C10M 2203/1025* (2013.01); *C10M 2207/024* (2013.01); *C10M 2207/026* (2013.01); *C10M 2207/028* (2013.01); *C10M 2207/262* (2013.01); *C10M 2207/281* (2013.01); *C10M 2207/289* (2013.01); *C10M 2207/40* (2013.01); *C10M 2209/101* (2013.01); *C10M 2215/064* (2013.01); *C10M 2219/046* (2013.01); *C10M 2223/045* (2013.01); *C10N 2230/10* (2013.01); *C10N 2230/12* (2013.01); *C10N 2230/70* (2013.01); *C10N 2240/102* (2013.01); *C10N 2240/30* (2013.01)

(58) Field of Classification Search

CPC ..... C10M 2207/024; C10M 129/10; C10M 2207/023

USPC ..... 508/417, 584

See application file for complete search history.

(56) References Cited

U.S. PATENT DOCUMENTS

| | | | | |
|---|---|---|---|---|
| 2,570,402 | A | 10/1951 | Stevens et al. | |
| 2,809,164 | A | 10/1957 | Oliver | |
| 6,002,051 | A * | 12/1999 | Burjes | C07C 37/14 568/722 |
| 2006/0223724 | A1 | 10/2006 | Gatto et al. | |
| 2008/0127550 | A1 | 6/2008 | Li et al. | |
| 2009/0111720 | A1 | 4/2009 | Boffa | |
| 2010/0016193 | A1 | 1/2010 | Habeeb et al. | |
| 2010/0269774 | A1 | 10/2010 | Sinoda et al. | |
| 2011/0023351 | A1 | 2/2011 | Poirier et al. | |
| 2011/0082062 | A1 | 4/2011 | Habeeb et al. | |
| 2011/0130316 | A1* | 6/2011 | Varadaraj | C10M 163/00 508/545 |

FOREIGN PATENT DOCUMENTS

| | | |
|---|---|---|
| EP | 2055761 | 5/2009 |
| WO | 2003091365 | 11/2003 |
| WO | 2008124390 | 10/2008 |
| WO | 2009013275 | 1/2009 |
| WO | 2014078083 | 5/2014 |

OTHER PUBLICATIONS

European Patent Office/ISA, Written Opinion for PCT/US13/067637, dated Feb. 7, 2014.

European Patent Office/ISA, Search Report for PCT/US13/067637, dated Feb. 7, 2014.

* cited by examiner

*Primary Examiner* — Prem C Singh
*Assistant Examiner* — Francis C Campanell
(74) *Attorney, Agent, or Firm* — Michael A. Miller; David M. Shold

(57) ABSTRACT

The invention provides a lubricating composition containing an oil of lubricating viscosity and an alkylene-coupled phenol compound for use in engines operated with biodiesel fuels or fuel blends containing biodiesel components. The invention further relates to methods of lubricating an internal combustion engine fueled with biodiesel by supplying the described lubricating composition to the internal combustion engine. The invention further relates to the use of the alkylene-coupled phenol compound to reduce corrosion and oxidative instability resulting from biodiesel introduction into the lubricant.

16 Claims, No Drawings

COUPLED PHENOLS FOR USE IN BIODIESEL ENGINES

BACKGROUND OF THE INVENTION

The disclosed technology relates to lubricants for internal combustion engine, particularly those fueled with biodiesel fuels.

Biodiesel is a general term for fuel-grade materials derived from natural sources such as vegetable oils. They are often fatty acid methyl esters ("FAME") such as rapeseed methyl ester ("RME") or soybean methyl ester ("SME"). Biodiesel fuels are becoming more prevalent for fueling of diesel engines. The increased use of diesel passenger vehicles in Europe and elsewhere is in part a cause of this increase. Current European diesel standard allow for 5% bio-diesel component to be incorporated into fuels, with indications that 10% bio-diesel content will be soon permitted.

Simultaneously, there is continued pressure for reducing particulate matter emissions from diesel engines. Euro 5 requirements require reduction in particulate matter to 0.05 g/km. Such levels can only be attained, practically, by use of a diesel particulate filter. These filters require regeneration once they are full of soot, and this is typically achieved by increasing the filter temperature to burn off the soot. The temperature increase is often achieved by post-injection of fuel into the engine cylinder.

However, post-injection of fuel can have the undesirable effect of fuel-dilution of the engine lubricant, as more cylinder wall wetting by the fuel allows more fuel to migrate to and accumulate in the lubricant sump. Bio-diesel components are typically less volatile than conventional mineral diesel fuel, and thus concentration of such components in the sump is exacerbated. In fact, use of bio-diesel fuel (B05, i.e., containing 5% ester) along with post-injection may result in 40% fuel dilution of the lubricant, and the bio-diesel component may account for 50% of the diluent. These high levels of bio-diesel in the oil may lead to increased oxidation and deposit formation associated with the lubricant.

United States application 2006/0223724 (Gatto et al., Oct. 5, 2006) teaches a lubricating oil of reduced phosphorus levels which retains excellent viscosity control; i.e., excellent oxidation stability. The oil comprises a major amount of one or more of a Group II, Group III, Group IV and synthetic ester base stock, 4,4'-methylenebis-(2,6-di-tert-butyl phenol), an alkylated diphenyl amine, a detergent and zinc dialkyldithiophosphate. Optionally an oil soluble organomolybdenum compound can be present, as can additional, different hindered phenolic antioxidants. The lubricant contains about 600 ppm or less phosphorus derived from ZDDP. A number of examples contain all three of ZDDP, a hindered phenol and an aromatic amine United States application 2009/0111720 (Boffa, Apr. 30, 2009) discloses lubricating oil compositions contaminated with biodiesel fuel wherein the lubricant contains diarylamine compounds to improve oxidative stability. Also disclosed is the optional addition of phenol based antioxidants including 4-methyl-2,6-di-tert-butylphenol and 4,4'-methylenebis-(2,6-di-tert-butylphenol).

United States application 2010/0016193 (Habeeb et al., Jan. 21, 2010) discloses lubricating compositions stabilized against the detrimental effects of biodiesel fuel by using a pre-mixture of two antioxidants, either of which may be phenolic. The phenolic compounds described include monophenols as well as bisphenol compounds, including alkylene-bridged materials. Listed types of coupled phenols include 2,2'-bis-(6-t-butyl-4-heptylphenol); 4,4'-bis(2,6-di-t-butyl phenol) and 4,4'-methylene-bis(2,6-di-t-butylphenol). 2,2'-methylene bridged bisphenols are not disclosed. Example 2 describes various combinations of antioxidants evaluated for oxidative resistance in the presence of biodiesel; included among these is an unidentified "bis-phenol."

United States application 2011/0130316 (Varadaraj et al., Jun. 2, 2011) discloses lubricating compositions stabilized against the detrimental effects of biodiesel fuel by using a combination of organic base, detergent, and antioxidant, selected from hindered amines and hindered phenols. The phenolic compounds described include mono-phenols as well as bisphenol compounds, including alkylene-bridged materials. 2,2'-methylene bridged bisphenols are not disclosed. Example 1 includes bisphenol Ethyl 702, which is identified as 4,4"-methylene-bis(2,6-di-t-butyl phenol).

United States application 2011/0082062 (Habeeb et al. Apr. 7, 2011) discloses a combination of detergent (e.g. alkali metal salicylate) and antioxidant (e.g. aminic antioxidants) to the biodiesel fuel or lubricating oil to improve oxidative resistance. As above, bisphenols are disclosed as part of the broad disclosure of phenolic antioxidants; however alkylene bridged 2,2'-bisphenols are neither disclosed nor exemplified.

United States application 2011/0023351 (Poirier et al., Feb. 3, 2011) discloses antioxidant mixtures of hindered phenol and diphenol for fuels containing biodiesel and biodiesel blends. Diphenols refer to aromatic groups containing two alcohol moieties on a single aromatic ring (e.g. hydroquinones). Bisphenols are not disclosed.

United States application 2010/0269774 (Shinoda et al., Oct. 28, 2010) discloses a lubricating composition containing a combination of phenolic antioxidant and amine-based antioxidant useful in diesel engines fueled with biofuel. Several phenolic antioxidants are disclosed, including 2,6-di-t-butylphenol, 2,2'-methylenebis(4-methyl-6-t-butylphenol), 2,2'-methylenebis(4-ethyl-6-t-butylphenol), 4,4'-bis-(2,6-di-t-butylphenol), and alkyl alcohol esters of 3-(4-hydroxy-3,5-di-t-butyl-phenyl)propionic acid. All experimental examples are carried out with 6-methylheptyl alcohol ester of 3-(4-hydroxy-3,5-di-t-butyl-phenyl)propionic acid.

WO/PCT application 2008/124390A2 (Lubrizol, Oct. 16, 2008) discloses a synergistic combination of a hindered phenolic anti-oxidant and a detergent to improve the oxidation stability of biodiesel fuel.

United States application 2008/0127550 (Li et al., Jun. 5, 2008) discloses stabilized biodiesel fuel composition wherein the stabilizing agent is a combination of: i) one or more compounds selected from the group consisting of sterically-hindered phenolic anti-oxidants; and ii) one or more compounds selected from the group consisting of triazole metal deactivators.

U.S. Pat. No. 6,002,051 (Burjes et al., Dec. 14, 1999) discloses compounds of the general formula

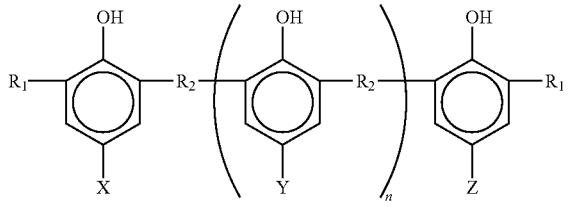

wherein each $R_1$ is a tertiary alkyl group, X, Y, and Z are a hydrocarbon-based group (or hydrogen), $R_2$ is alkylene or alkylidene, and n is 0 to 4. Lubricants and fuels may contain such phenolic compounds.

PCT Publication WO 2003/091365 (Jackson et al., Nov. 6, 2003) discloses a method of operating an internal combustion engine in which an antioxidant composition is introduced into a combustion chamber of the engine. The antioxidant composition contains, among other components, an alkylene or alkylidene coupled sterically hindered phenol oligomer. A normally liquid hydrocarbon fuel is disclosed which may be, among others disclosed, diesel fuel and methyl esters of vegetable or animal oils The disclosed technology provides a lubricant composition suitable for sump lubricated engines fueled by a liquid fuel which includes a bio-diesel component, which exhibits improved corrosion resistance and improved oxidation resistance in lubricants which contain a portion of the bio-diesel component. This is accomplished by the presence of an alkylene-coupled phenol compound. While a bio-diesel component will typically be prepared from a biological source (an animal or vegetable fat or oil), it is to be understood that the disclosed technology is equally applicable if the bio-diesel component or bio-diesel fuel, such as a fatty acid ester, is prepared from a synthetic source, that is, not derived from an animal or vegetable fat or oil.

SUMMARY OF THE INVENTION

The present invention provides a lubricating composition containing, i.e., contaminated with, at least 0.1 wt. % of a biodiesel fuel or a decomposition product thereof, based on the total weight of the lubricating oil composition, said lubricating composition further comprising an oil of lubricating viscosity and an antioxidant which comprises an alkylene-coupled phenol, wherein the alkylene-coupled phenol comprises at least two phenol units, at least one phenol unit thereof having a hydrocarbyl substituent in the position para to the hydroxy group thereof; an alkyl group, hydrocarbyl-substituted in the 1 and/or 2 position, in a position ortho to the hydroxy group; and an alkylene linking group in the other ortho position.

As otherwise expressed, the present invention provides a lubricating oil composition containing or contaminated with at least 0.1 wt. % of a biodiesel fuel or a decomposition product thereof, based on the total weight of the lubricating oil composition, said lubricating composition further comprising an oil of lubricating viscosity and an antioxidant (which may be present in an amount of 0.05 to 8 weight percent) which comprises an alkylene-coupled phenol, wherein the alkylene-coupled phenol comprises at least two phenol units, at least one phenol unit thereof having a hydrocarbyl substituent (or, optionally, an ester-substituted hydrocarbyl substituent) in the position para to the hydroxy group of said phenol unit; an alkyl group which is hydrocarbyl-substituted in the 1 and/or 2 position thereof, located in a position ortho to the hydroxy group of said phenol unit; and an alkylene linking group in the other ortho position of said phenol unit.

The present invention further provides a lubricating oil composition containing or contaminated with at least 0.1 wt. % of a biodiesel fuel or a decomposition product thereof, based on the total weight of the lubricating oil composition, said lubricating composition further comprising an oil of lubricating viscosity and an antioxidant (which may be present in an amount of 0.05 to 8 weight percent) which comprises an alkylene-coupled phenol represented by the formula

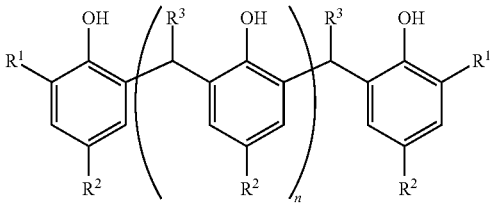

wherein each $R^1$ is independently hydrogen or an alkyl group of 3 to about 12 carbon atoms where at least one $R^1$ is an alkyl group substituted in the 1 or 2 position with a hydrocarbyl group of 1 to 3 carbon atoms; each $R^3$ is independently hydrogen or a methyl group; n is 0 to 3, and each $R^2$ is independently a hydrocarbyl group of 1 to about 30 carbon atoms or such a hydrocarbyl group substituted by an ester group.

Also provided is a method for lubricating a sump-lubricated internal combustion engine fueled by a liquid fuel which comprises a biodiesel component comprising a C1-C3 or C1-C4 alkyl ester of a carboxylic acid of 12 to 24 carbon atoms, comprising supplying to the sump a lubricant comprising an oil of lubricating viscosity and a minor amount of an alkylene-coupled phenol compound bridged in the ortho position.

As otherwise expressed, also provided is a method for lubricating a diesel engine fueled with a liquid fuel containing at least about 2 percent by weight of a fatty acid alkyl ester, comprising supplying to said engine a lubricant comprising an oil of lubricating viscosity and about 0.05 to about 8 weight percent of an antioxidant (which may be present in an amount of 0.5 to 8 weight percent) which comprises an alkylene-coupled phenol, wherein the alkylene-coupled phenol comprises at least two phenol units, at least one phenol unit thereof having a hydrocarbyl substituent (or, optionally, an ester-substituted hydrocarbyl substituent) in the position para to the hydroxy group of said phenol unit; an alkyl group which is hydrocarbyl-substituted in the 1 and/or 2 position thereof, located in a position ortho to the hydroxy group of said phenol unit; and an alkylene linking group in the other ortho position of said phenol unit.

Also provided is a method for improving corrosion resistance and oxidative resistance of a lubricant composition which contains an oil of lubricating viscosity and at least 0.1 or at least 0.5 percent by weight of a C1-C3 or C1-C4 alkyl ester of a carboxylic acid of 12 to 24 carbon atoms, the presence of which may arise from dilution of the lubricant by a liquid fuel, comprising including within said lubricant composition a minor amount of an alkylene-coupled phenol compound bridged in the ortho position.

DETAILED DESCRIPTION OF THE INVENTION

Various preferred features and embodiments will be described below by way of non-limiting illustration.

The lubricant as described herein is particularly useful for lubricating diesel engines that are fueled with a liquid fuel that comprises a bio-diesel fuel, that is, that contains a certain amount, e.g., at least 2 percent by weight, of a C1-C3 or C1-C4 alkyl ester of a carboxylic acid of 12 to 24 carbon atoms. Such alkyl groups may include methyl, ethyl, 1-propyl, 2-propyl, n-butyl, sec-butyl, isobutyl, or tert-butyl. The amount of such ester in the liquid fuel may be 2 to 100% by weight, or 4 to 100% or 5 to 100% or 10 to 100%, for instance, 4 to 12% or 5 to 10% or generally 2, 4, 5, 10 or 12% up to 100 or 90 or 80 or 50 or 30%. These percentages are normally calculated on the basis of the liquid fuel excluding any performance additives that may be present. The balance of the fuel may be a petroleum-derived fuel or fraction, such as a middle distillate fuel or other petroleum fuel conventionally used to fuel a diesel engine. The amount of sulfur in the fuel may be less than 300 parts per million by weight for low sulfur fuels, or less than 50 ppm or less than 10 ppm, e.g., 1 to 10 ppm S for ultra-low sulfur fuels. Fuels may also contain higher levels of sulfur, such as up to 1000 ppm or 300 to 500 ppm. Any sulfur which is present may come from the bio-diesel component or from a petroleum fraction or both.

Biodiesel Fuel

Bio-diesel fuels can be derived from animal fats and/or vegetable oils to include biomass sources such as plant seeds as described in U.S. Pat. No. 6,166,231, The esters may thus be methyl, ethyl, propyl, or isopropyl esters. The carboxylic acids may be derived from natural or synthetic sources and may contain a relatively pure or single component of acid in terms of chain length, branching, and the like, or they may be mixtures of acids characteristic of acids obtained from animal or, especially, vegetable sources.

Bio-diesel fuels thus include esters of naturally occurring fatty acids such as the methyl ester of rapeseed oil which can generally be prepared by transesterifying a triglyceride of a natural fat or oil with an aliphatic alcohol having 1 to 3 carbon atoms. Other suitable materials include the methyl esters of soybean oil (SME), sunflower oil, coconut oil, corn oil, olive oil, palm oil, jatropha oil, peanut oil, canola oil, babassu oil, castor oil, rapeseed oil (RME), and sesame seed oil. Such materials comprise a mixture of acids most typically of 8 to 24 or 12 to 22 or 16 to 18 carbon atoms, with varying degrees of branching or unsaturation. In one embodiment, the bio-diesel is a methyl ester of a carboxylic acid having about 12 to about 24 carbon atoms and having at least one olefinic double bond (as often found in carboxylic acids derived or derivable from plant sources). Rapeseed oil, for instance, is believed to comprise largely oleic acid (C18), linoleic acid (C18), linolenic acid (C18), and in some cases erucic acid (C22). Certain amounts of vegetable oils (triglycerides) may also be included in some embodiments. In one embodiment the biodiesel fuel is derived from soybean oil (i.e. SME) or rapeseed oil (RME) or combinations thereof.

The biodiesel fuels may be used as the exclusive fuel or as an addition to another fuel component such as hydrocarbon-based diesel fuels. If used with another fuel component, such other fuel is normally a liquid at ambient conditions, e.g., room temperature (20 to 30° C.). The fuel can be a hydrocarbon fuel, a nonhydrocarbon fuel, or a mixture thereof. The hydrocarbon fuel can be a petroleum distillate such as a diesel fuel as defined by ASTM specification D975. In one embodiment the fuel is a diesel fuel. The hydrocarbon fuel can be a hydrocarbon prepared by a gas to liquid process including, for example, hydrocarbons prepared by a process such as the Fischer-Tropsch process. A nonhydrocarbon fuel can be an oxygen containing composition, often referred to as an oxygenate, such as an alcohol, an ether, a ketone, an ester of a carboxylic acid, a nitroalkane, or mixtures thereof. The nonhydrocarbon fuel can include, for example, methanol, ethanol, methyl t-butyl ether, methyl ethyl ketone, or nitromethane. In some embodiments the fuel can have a sulfur content on a weight basis of 5000 ppm or less, 1000 ppm or less, 300 ppm or less, 200 ppm or less, 30 ppm or less, or 10 ppm or less. In another embodiment the fuel can have a sulfur content on a weight basis of 1 to 100 ppm. In one embodiment the fuel contains 0 ppm to 1000 ppm, 0 to 500 ppm, 0 to 100 ppm, 0 to 50 ppm, 0 to 25 ppm, 0 to 10 ppm, or 0 to 5 ppm of alkali metals, alkaline earth metals, transition metals, or mixtures thereof. In another embodiment the fuel contains 1 to 10 ppm by weight of alkali metals, alkaline earth metals, transition metals, or mixtures thereof. It is known that a fuel containing alkali metals, alkaline earth metals, transition metals, or mixtures thereof may have a greater tendency to form deposits and therefore foul or plug common rail injectors.

When used as an addition to hydrocarbon-based diesel fuels, the biodiesel fuels may constitute anywhere from 2 to 50 wt. % of the resulting diesel fuel blends, such as 5 to 30 wt. % of the blend. In Europe biodiesel fuels either are being considered or already have been mandated for use in hydrocarbon-based diesel fuels in an amount in the range of 5 to 10 wt. %.

Fuels constituting 100% biodiesel materials are designated B100, while fuels of lesser biodiesel material content are designated in terms of that content, e.g., fuels containing 20% biodiesel component are designated B20. The designation is usually in terms of weight.

Examples of oils useful for the preparation of the fatty acid ester, which are derived from animal or vegetable material, include rapeseed oil, coriander oil, soya oil, cottonseed oil, sunflower oil, castor oil, olive oil, peanut oil, maize oil, almond oil, palm seed oil, coconut oil, mustard seed oil, bovine tallow, bone oil and fish oils. Further examples include oils which are derived from wheat, jute, sesame, shea tree nut, arachis oil and linseed oil. The fatty acid alkyl esters of the present invention can be derived from these oils by processes known from the prior art. Rapeseed oil, which is a mixture of fatty acids partially esterified with glycerol, is a commonly used oil to make the alkyl fatty acid ester, because it is obtainable in large amounts and is obtainable in a simple manner by extractive pressing of rapeseeds.

Useful alkyl fatty acid esters can include, for example, the methyl, ethyl, propyl, and butyl esters of fatty acids having from 12 to 22 carbon atoms, for example of lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleinic acid, docosanoic acid, or erucic acid. In one embodiment, alkyl fatty acid esters are the methyl esters of oleic acid, linoleic acid, linolenic acid, and erucic acid.

The alkyl fatty acid ester of the present invention are obtained, for example, by hydrolyzing and esterifying animal and vegetable fats and oils by transesterifying them with relatively low aliphatic alcohols. To prepare the low alkyl esters of fatty acids, it is advantageous to start from fats and oils having a high iodine number, for example sunflower oil, rapeseed oil, coriander oil, castor oil, soya oil, cottonseed oil, peanut oil or bovine tallow.

Bio-diesel fuels, being hydrocarbyl esters, are susceptible to decomposition, especially by hydrolysis of said ester to produce hydrocarbyl alcohols, such as methanol, ethanol, and propanol, and fatty acids or salts thereof. In one embodiment, the lubricating composition is contaminated with at least 0.1 weight % bio-diesel decomposition products which may comprise C1 to C3 hydrocarbyl alcohols, fatty acids of 8 to 24 carbon atoms, amine or metal salts of said fatty acids, or mixtures thereof.

Oil of Lubricating Viscosity

One component of the disclosed technology is an oil of lubricating viscosity. The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAO) | | | |
| Group V | All others not included in Groups I, II, III, or IV | | | |

In one embodiment, the base oil as used in the present technology has less than 300 ppm sulfur and/or at least 90% saturate content, by ASTM D2007. In certain embodiments, the base oil has a viscosity index of at least 95 or at least 115. In one embodiment, the base oil of the invention has a viscosity index of at least 120 and is a polyalphaolefin or is comprised of mixtures of such materials.

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil, and other vegetable acid esters) as well as mineral lubricating oils such as liquid petroleum oils and solvent-treated or acid treated mineral lubricating oils of the paraffinic, naphthenic, or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof. Alkylene oxide polymers and interpolymers and derivatives thereof, and those where terminal hydroxyl groups have been modified by, for example, esterification or etherification, constitute other classes of known synthetic lubricating oils that can be used. Another suitable class of synthetic lubricating oils that can be used comprises the esters of dicarboxylic acids and those made from C5 to C12 monocarboxylic acids and polyols or polyol ethers.

Other suitable synthetic lubricating oils include liquid esters of phosphorus-containing acids, polymeric tetrahydrofurans, silicon-based oils such as the poly-alkyl-, polyaryl-, polyalkoxy-, or polyaryloxy-siloxane oils, and silicate oils.

Hydrotreated naphthenic oils are also known and can be used. Synthetic oils may be used, such as those produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The amount of oil in a fully formulated lubricant will typically be the amount remaining to equal 100 percent after the remaining additives are accounted for. Typically this may be 60 to 99 percent by weight, or 70 to 97 percent, or 80 to 95 percent, or 85 to 93 percent. The disclosed technology may also be delivered as a concentrate, in which case the amount of oil is typically reduced and the concentrations of the other components are correspondingly increased. In such cases the amount of oil may be 30 to 70 percent by weight or 40 to 60 percent.

Alkylene-Coupled Phenol Compound

The present invention provides a lubricating composition containing an oil of lubricating viscosity and an alkylene-coupled phenol compound bridged in the ortho position of the phenol, i.e., in the 2-position of the phenol ring where the hydroxy-group of the phenol is taken as the 1-position.

In one embodiment, the alkylene-coupled phenol is represented by formula (1):

Formula (1)

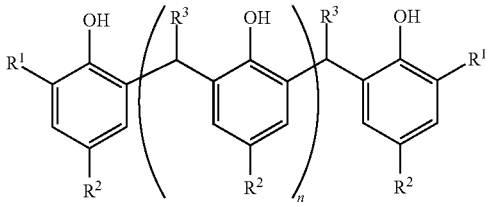

wherein each $R^1$ is independently hydrogen or an alkyl group of 3 to 12 carbon atoms where at least one $R^1$ is an alkyl group substituted in the 1 or 2 position (or both 1 and 2 positions) with a hydrocarbyl group which may, in certain embodiments, be a hydrocarbyl group of 1 to 3 carbon atoms; each $R^3$ is independently hydrogen or a hydrocarbyl group having 1 to 12 carbon atoms; n is 0 to 3; and each $R^2$ is independently a hydrocarbyl group of 1 to 30 carbon atoms, e.g., 1 to 4, or 1 carbon atom or such a hydrocarbyl group substituted by an ester group. An ester-substituted hydrocarbyl group of 2 carbons, for instance, may be represented by the formula $—CH_2CH_2C(O)OR^4$ where $R^4$ is a $C_1$ to $C_{12}$ alkyl group, e.g., a $C_4$ to $C_8$ alkyl group.

The substitution within the $R^1$ group, at the 1 and/or 2 position, may be substitution by one or more alkyl groups. In certain embodiments the $R^1$ group may be a cyclohexyl group, that is, effectively having substitution at the 1-position by an alkyl group that is itself part of a cyclic structure. Thus the hydrocarbyl group substituent may also be a part of a cyclic hydrocarbyl group.

In one embodiment the alkylene-coupled phenol is represented by formula (2):

Formula (2)

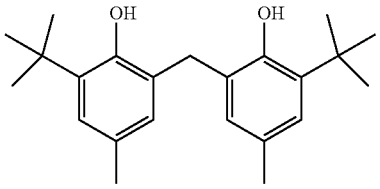

In one embodiment, the alkylene-coupled phenol compound is 2,2'-methylenebis(4-methyl-6-t-butylphenol), for example Cyanox® 2246 available from Cytec Industries, Irganox® 2246 available from BASF, or Lowinox® 22M46 available from Chemtura.

The alkylene-coupled phenol may be prepared by reaction of a 2,4-dialkylphenol with an aldehyde or ketone. In one embodiment, the present invention provides a method of making an alkylene-coupled phenol, said method comprising forming an 2,4-alkylated hydrocarbyl phenol aldehyde condensate via condensation of a hydrocarbyl phenol with an aldehyde, in the presence of an acid or base catalyst, to form a hydrocarbyl phenol-aldehyde condensate. Suitable aldehydes include formaldehyde (and reactive equivalents), acetaldehyde, and propionaldehyde. Suitable ketones include acetone and methyl ethyl ketone. In one embodiment, the hydrocarbyl phenol is coupled with formaldehyde or reactive equivalent.

In certain embodiments, used in combination with any of the embodiments described above, the alkylene-coupled phenol may be present in a lubricating composition at 0.1, 0.3, 0.5, 1.0, or 1.5 percent by weight or more. In still other embodiments, the alkylene-coupled phenol may be present within a range having a lower limit of 0.1, 0.3, 0.5, 1.0, or 1.5 percent by weight and an upper limit of 1.0, 2.0, 3.0, 4.0, 4.5, 5.0, or 8.0 percent by weight.

Other Performance Additives

In some embodiments, the compositions of the present invention contain one or more additional additives. A suitable additional additive is a detergent, where the detergent is different from the aniline derivative described above.

Most conventional detergents used in the field of engine lubrication obtain most or all of their basicity or TBN from the presence of basic metal-containing compounds (metal hydroxides, oxides, or carbonates, typically based on such metals as calcium, magnesium, zinc, or sodium). Such metallic overbased detergents, also referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are typically prepared by reacting an acidic material (typically an inorganic acid or lower carboxylic acid such as carbon dioxide) with a mixture of an acidic organic compound (also referred to as a substrate), a stoichiometric excess of a metal base, typically in a reaction medium of an one inert, organic solvent (e.g., mineral oil, naphtha, toluene, xylene) for the acidic organic substrate. Typically also a small amount of promoter such as a phenol or alcohol is present, and in some cases a small amount of water. The acidic organic substrate will normally have a sufficient number of carbon atoms to provide a degree of solubility in oil.

Such conventional overbased materials and their methods of preparation are well known to those skilled in the art. Patents describing techniques for making basic metallic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Salixarate detergents are described in U.S. Pat. No. 6,200,936.

The overbased metal-containing detergent may be selected from the group consisting of non-sulfur containing phenates, sulfur containing phenates, sulfonates, salixarates, salicylates, and mixtures thereof, or borated equivalents thereof. The overbased detergent may be borated with a borating agent such as boric acid.

In one embodiment the overbased metal-containing detergent may be zinc, sodium, calcium or magnesium salts of a phenate, sulfur containing phenate, sulfonate, salixarate or salicylate. The metal component may thus include an alkali metal such as Na, Li, or K, or an alkaline earth metal such as Mg or Ca, or another metal. Overbased salixarates, phenates and salicylates typically have a total base number (ASTM D3896) of 180 to 450 TBN. Overbased sulfonates typically have a total base number of 250 to 600, or 300 to 500. Overbased detergents are known in the art. In one embodiment the sulfonate detergent may be a predominantly linear alkylbenzene sulfonate detergent having a metal ratio of at least 8 as is described in paragraphs [0026] to [0037] of US Patent Application 2005-065045. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The predominantly linear alkylbenzene sulfonate detergent may be particularly useful for assisting in improving fuel economy. In some embodiments the linear alkyl group may be attached to the benzene ring anywhere along the linear chain of the alkyl group, but often in the 2, 3 or 4 position of the linear chain, and in some instances predominantly in the 2 position.

In one embodiment the overbased metal-containing detergent is calcium or magnesium overbased detergent. In one embodiment, the lubricating composition comprises an overbased calcium sulfonate, an overbased calcium phenate, an overbased calcium salicylate, or mixtures thereof. In one embodiment, the lubricating composition comprises an overbased calcium salicylate. The overbased detergent may comprise calcium sulfonate or calcium salicylate with a metal ratio of at least 3.

The overbased detergent of the invention may be present in an amount from 0.05% by weight to 5% by weight of the composition. In other embodiments the overbased detergent may be present from 0.1%, 0.3%, or 0.5% up to 3.2%, 1.7%, or 0.9% by weight of the lubricating composition. Similarly, the overbased detergent may be present in an amount suitable to provide from 1 TBN to 10 TBN to the lubricating composition. In other embodiments the overbased detergent is present in amount which provides from 1.5 TBN or 2 TBN up to 3 TBN, 5 TBN, or 7 TBN to the lubricating composition.

The lubricating composition of the invention optionally comprises other performance additives. The other performance additives include at least one of metal deactivators, viscosity modifiers, friction modifiers, antiwear agents, corrosion inhibitors, dispersants, dispersant viscosity modifiers, extreme pressure agents, antioxidants, foam inhibitors, demulsifiers, pour point depressants, seal swelling agents, and mixtures thereof. Typically, fully-formulated lubricating oil will contain one or more of these performance additives.

One such additive is a dispersant. Dispersants are well known in the field of lubricants and include primarily what is known as ashless-type dispersants and polymeric dispersants. Ashless type dispersants are characterized by a polar group attached to a relatively high molecular weight hydrocarbon chain. Typical ashless dispersants include nitrogen-containing dispersants such as N-substituted long chain alkenyl succinimides, also known as succinimide dispersants. Succinimide dispersants are more fully described in U.S. Pat. Nos. 4,234,435 and 3,172,892. Another class of ashless dispersant is high molecular weight esters, prepared by reaction of a hydrocarbyl acylating agent and a polyhydric aliphatic alcohol such as glycerol, pentaerythritol, or sorbitol. Such materials are described in more detail in U.S. Pat. No. 3,381,022. Another class of ashless dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Other dispersants include polymeric dispersant additives, which are generally hydrocarbon-based polymers which contain polar functionality to impart dispersancy characteristics to the polymer. Dispersants can also be post-treated by reaction with any of a variety of agents. Among these are urea, thiourea, dimercaptothi-adiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403. The amount of dispersant in the present composition can typically be 1 to 10 weight percent, or 1.5 to 9.0 percent, or 2.0 to 8.0 percent, all expressed on an oil-free basis.

Another component may be an antioxidant, different from that of the alkylene-coupled phenol of the invention. Antioxidants encompass phenolic antioxidants, which may comprise a butyl substituted phenol containing 2 or 3 t-butyl groups. The para position may also be occupied by a hydrocarbyl group or a group bridging two aromatic rings. The latter antioxidants are described in greater detail in U.S. Pat. No. 6,559,105. Antioxidants also include aromatic amines, such as nonylated diphenylamine. Other antioxidants include sulfurized olefins, titanium compounds, and molybdenum compounds. U.S. Pat. No. 4,285,822, for instance, discloses lubricating oil compositions containing a molybdenum and sulfur containing composition. Typical amounts of antioxidants will, of course, depend on the specific antioxidant and its individual effectiveness, but illustrative total amounts can be 0.01 to 5, or 0.15 to 4.5, or 0.2 to 4 percent by weight. Additionally, more than one antioxidant may be present, and certain combinations of these can be synergistic in their combined overall effect.

In one embodiment, the alkylene coupled phenol compound of the present invention is used in combination with at least one additional ash-free antioxidant selected from hindered phenols different from the present invention and diarylamines. In one embodiment, the lubricating composition of the invention comprises less than 0.3 weight % of a diarylamine antioxidant; and in some embodiments the lubricating composition of the invention is free of or substantially free of (i.e. less than 0.03 weight %) a diarylamine antioxidant. In certain embodiments, the alkylene-coupled phenol antioxidant of the disclosed technology comprises at least 67 percent by weight of the total amount of the ashless (that is, other than metal-containing) antioxidants of the composition. In other embodiments, the amount of the alkylene-coupled phenol antioxidant may be 75-100%, or 80-100%, or 90-100%, or 95-100%, or 95-99.5%, or 95-1% of the total ashless antioxidants. Any other ashless antioxidants (e.g., aminic antioxidants, sulfur-containing antioxidants, or other phenolic antioxidants), will be the complementary amounts so as to equal 100% and may be, for instance, 0.5 to 25%. In certain embodiments they will be absent or substantially absent, e.g., 0 or near 0%. For reference, certain metal-containing materials such as zinc dialkyldithiophosphates may impart some antioxidant performance, but they are not ashless or metal-free materials and are not to be counted as such.

Viscosity improvers (also sometimes referred to as viscosity index improvers or viscosity modifiers) may be included in the compositions of this invention. Viscosity improvers are usually polymers, including polyisobutenes, poly(meth)-acrylates (PMA) and poly(meth)acrylic acid esters, hydrogenated diene polymers, polyalkylstyrenes, esterified styrene-maleic anhydride copolymers, hydrogenated alkenylarene-conjugated diene copolymers and polyolefins. PMA's are prepared from mixtures of methacrylate monomers having different alkyl groups. The alkyl groups may be either straight chain or branched chain groups containing from 1 to 18 carbon atoms. Most PMA's are viscosity modifiers as well as pour point depressants.

Multifunctional viscosity improvers, which also have dispersant and/or antioxidancy properties, are known and may optionally be used. Dispersant viscosity modifiers (DVMs) are one example of such multifunctional additives. DVMs are typically prepared by copolymerizing a small amount of a nitrogen-containing monomer with alkyl methacrylates, resulting in an additive with some combination of dispersancy, viscosity modification, pour point depressancy, and dispersancy. Vinyl pyridine, N-vinyl pyrrolidone, and N,N'-dimethylaminoethyl methacrylate are examples of nitrogen-containing monomers. Polyacrylates obtained from the polymerization or copolymerization of one or more alkyl acrylates also are useful as viscosity modifiers.

The dispersant viscosity modifier may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph[0008] and preparative examples described in paragraphs [0065] to [0073]).

In one embodiment the lubricating composition of the invention further comprises a dispersant viscosity modifier. The dispersant viscosity modifier may be present at 0 wt. % to 15 wt. %, or 0 wt. % to 10 wt. %, or 0.05 wt. % to 5 wt. %, or 0.2 wt. % to 2 wt. % of the lubricating composition.

In certain embodiments, the dispersant or dispersant viscosity modifier comprises a polymer functionalized with a certain type of amine. The amine used for the polymeric dispersant may be an amine having at least 2 or at least 3 or at least 4 aromatic groups, for instance, 4 to 10 or 4 to 8 or 4 to 6 aromatic groups, and at least one primary or secondary amino group or, alternatively, at least one secondary amino group. In some embodiments the amine comprises both a primary and at least one secondary amino group. In certain embodiments, the amine comprises at least 4 aromatic groups and at least 2 secondary or tertiary amino groups.

Another additive is an antiwear agent. Examples of antiwear agents include phosphorus-containing antiwear/extreme pressure agents such as metal thiophosphates, phosphoric acid esters and salts thereof, phosphorus-containing carboxylic acids, esters, ethers, and amides; and phosphites. In certain embodiments a phosphorus antiwear agent may be present in an amount to deliver 0.01 to 0.2 or 0.015 to 0.15 or 0.02 to 0.1 or 0.025 to 0.08 percent by weight phosphorus. Often the antiwear agent is a zinc dialkyldithiophosphate (ZDP). For a typical ZDP, which may contain 11 percent P (calculated on an oil free basis), suitable amounts may include 0.09 to 0.82 percent by weight. Non-phosphorus-containing anti-wear agents include borate esters (including borated epoxides), dithiocarbamate compounds, molybdenum-containing compounds, and sulfurized olefins.

Other additives that may optionally be used in lubricating oils include pour point depressing agents, extreme pressure agents, color stabilizers and anti-foam agents. One or more metal-containing detergents, as described above, may also be included.

The foregoing lubricating oil additives may be added directly to the base oil to form the lubricating oil composition. In one embodiment, however, one or more of the additives may be diluted with a substantially inert, normally liquid organic diluent such as mineral oil, synthetic oil, naphtha, alkylated (e.g., $C_{10}$-$C_{13}$ alkyl) benzene, alkylated toluene or alkylated xylene to form an additive concentrate. These concentrates may contain from 1 to 99 percent by weight, and in one embodiment from 10 to 90 percent by weight of such diluent. The concentrates may be added to the base oil to form the lubricating oil composition.

In some embodiments the lubricating compositions of the present invention comprise at least one additive selected from the group consisting of non-phosphorus-containing anti-wear agents, ashless dispersants, antioxidants, friction modifiers, zinc dithiophosphates, and corrosion inhibitors.

The lubricating compositions of the present invention may have an overall TBN of greater than 6, for example, a TBN of at least 7, 8, 9, 10 or greater, and optionally up to a TBN of 25, up to 18, or up to 13. In still other embodiments the lubricating compositions of the present invention also have a sulfated ash content of less than 1.5, 1.3, or 1.0 percent by weight and, in some embodiments, at least 0.1 percent.

The lubricating compositions of the present invention may have a nitrogen content of less than 0.4 or 0.3 percent by weight and/or a soap content of less than 5 or 3 percent by weight and, in some embodiments may have a nitrogen content of at least 0.01 percent by weight and/or a soap content of at least 0.1 percent by weight.

In different embodiments the lubricating composition may have a composition as described in the following table:

| Additive | Embodiments (wt %) A | B | C |
|---|---|---|---|
| The disclosed alkylene-coupled phenol (antioxidant) | 0.05 to 1 or 0.1 to 8 | 0.2 to 3 or 0.3 to 5 | 0.5 to 2 or 1.0 to 4 |
| Dispersant | 0.05 to 12 | 0.75 to 8 | 0.5 to 6 |
| Dispersant Viscosity Modifier | 0 or 0.05 to 5 | 0 or 0.05 to 4 | 0.05 to 2 |
| Overbased Detergent | 0 or 0.05 to 15 | 0.1 to 10 | 0.2 to 8 |
| Antioxidant (other than the disclosed alkylene coupled phenol) | 0 or 0.05 to 15 or 0 or 0.01 to 5 | 0.1 to 10 or 0.15 to 4.5 | 0.5 to 5 or 0.2 to 4 |
| Antiwear Agent | 0 or 0.05 to 15 | 0.1 to 10 | 0.3 to 5 |
| Friction Modifier | 0 or 0.05 to 6 | 0.05 to 4 | 0.1 to 2 |
| Viscosity Modifier | 0 or 0.05 to 10 | 0.5 to 8 | 1 to 6 |
| Any Other Performance Additive | 0 or 0.05 to 10 | 0 or 0.05 to 8 | 0 or 0.05 to 6 |
| Oil of Lubricating Viscosity | Balance to 100 | Balance to 100 | Balance to 100 |

Industrial Application

In one embodiment the invention provides a method of lubricating an internal combustion engine comprising the step of supplying to the internal combustion engine a lubricating composition as disclosed herein. Generally the lubricant is added to the lubricating system of the internal combustion engine, which then delivers the lubricating composition to the critical parts of the engine, during its operation, that require lubrication.

The lubricating compositions described above may be utilized in an internal combustion engine. The engine components may have a surface of steel or aluminum (typically a surface of steel), and may also be coated for example with a diamond like carbon (DLC) coating.

An aluminum surface may be comprised of an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

The internal combustion engine or diesel engine of the present invention is distinct from gas turbine. In an internal combustion engine individual combustion events are translated from a linear reciprocating force into a rotational torque through the rod and crankshaft. In contrast, in a gas turbine (may also be referred to as a jet engine) there is a continuous combustion process that generates a rotational torque continuously without translation and can also develop thrust at the exhaust outlet. These differences result in the operation conditions of a gas turbine and internal combustion engine different operating environments and stresses.

The lubricant composition for an internal combustion engine may be suitable for any engine lubricant irrespective of the sulfur, phosphorus, or sulfated ash (ASTM D-874) content. The sulfur content of the engine oil lubricant may be 1 wt. % or less, or 0.8 wt. % or less, or 0.5 wt. % or less, or 0.3 wt. % or less. In one embodiment the sulfur content may be in the range of 0.001 wt. % to 0.5 wt. %, or 0.01 wt. % to 0.3 wt. %. The phosphorus content may be 0.2 wt. % or less, or 0.12 wt. % or less, or 0.1 wt. % or less, or 0.085 wt. % or less, or 0.08 wt. % or less, or even 0.06 wt. % or less, 0.055 wt. % or less, or 0.05 wt. % or less. In one embodiment the phosphorus content may be 100 ppm to 1000 ppm, or 200 ppm to 600 ppm. The total sulfated ash content may be 2 wt. % or less, or 1.5 wt. % or less, or 1.1 wt. % or less, or 1 wt. % or less, or 0.8 wt. % or less, or 0.5 wt. % or less, or 0.4 wt. % or less. In one embodiment the sulfated ash content may be 0.05 wt. % to 0.9 wt. %, or 0.1 wt. % to 0.2 wt. % or to 0.45 wt. %.

In one embodiment the lubricating composition may be an engine oil, wherein the lubricating composition may be characterized as having at least one of (i) a sulfur content of 0.5 wt. % or less, (ii) a phosphorus content of 0.1 wt. % or less, (iii) a sulfated ash content of 1.5 wt. % or less, or combinations thereof.

Specific Embodiment

The invention will be further illustrated by the following examples, which sets forth particularly advantageous embodiments. While the examples are provided to illustrate the invention, they are not intended to limit it.

Coupled phenols are used as purchased from Sigma-Aldrich. Additive A (ADD A) is 2,2'-Methylenebis[4-methyl-6-t-butylphenol]; additive B (ADD B) is 2,2'-Methylenebis[4-ethyl-6-t-butylphenol]; additive C (ADD C) is 2,2-Methylenebis[4-methyl-6-(α-methylcyclohexyl)phenol]. Comparative additive D (ADD D) is 4,4'-methylenebis(2,6-di-t-butyl phenol).

Lubricating Compositions

A series of 15W-40 engine lubricants in Group II base oil of lubricating viscosity are prepared containing the additives described above as well as conventional additives including polymeric viscosity modifier, ashless succinimide dispersant, overbased detergents, antioxidants (combination of phenolic ester and diarylamine), zinc dialkyldithiophosphate (ZDDP), as well as other performance additives as follows (Table 1). The phosphorus, sulfur and ash contents of each of the examples are also presented in the table in part to show that each example has a similar amount of these materials and so provide a proper comparison between the comparative and invention examples.

TABLE 1

| | Lubricating Oil Composition Formulations[1] | | | | | | | |
|---|---|---|---|---|---|---|---|---|
| | COMP EX1 | COMP EX2 | COMP EX3 | INV EX4 | INV EX5 | INV EX6 | INV EX7 | INV Ex8 |
| Group II Base Oil | Balance to 100% | | | | | | | |
| ADD A | | | | 0.5 | 1.0 | | | 2.0 |
| ADD B | | | | | | 1.0 | | |

TABLE 1-continued

| Lubricating Oil Composition Formulations[1] | | | | | | | | |
|---|---|---|---|---|---|---|---|---|
| | COMP EX1 | COMP EX2 | COMP EX3 | INV EX4 | INV EX5 | INV EX6 | INV EX7 | INV Ex8 |
| ADD C | | | | | | | 1.0 | |
| ADD D | | | 1.0 | | | | | |
| Phenolic AO[2] | 0.5 | 1.5 | 0.5 | 0.5 | 0.5 | 0.5 | 0.5 | — |
| Aminic AO[3] | 0.7 | 0.7 | 0.7 | 0.7 | 0.7 | 0.7 | 0.7 | — |
| TOTAL AO | 1.2 | 2.2 | 2.2 | 1.7 | 2.2 | 2.2 | 2.2 | 2.0 |
| Detergent[4] | 2.2 | 2.2 | 2.2 | 2.2 | 2.2 | 2.2 | 2.2 | 2.2 |
| ZDDP (2°) | 0.70 | 0.70 | 0.70 | 0.70 | 0.70 | 0.70 | 0.70 | 0.70 |
| Additional Additives[5] | 5.7 | 5.7 | 5.7 | 5.7 | 5.7 | 5.7 | 5.7 | 5.7 |
| % Phosphorus | 0.076 | 0.076 | 0.076 | 0.076 | 0.076 | 0.076 | 0.076 | 0.076 |
| % Sulfur | 0.26 | 0.26 | 0.26 | 0.26 | 0.26 | 0.26 | 0.26 | 0.26 |
| % Ash | 0.98 | 0.98 | 0.98 | 0.98 | 0.98 | 0.98 | 0.98 | 0.98 |

[1]All amounts shown above are in weight percent and are on an oil-free basis unless otherwise noted.

[2]Phenolic AO is 2,6-di-alkyl-phenolic propionic ester

[3]Aminic AO is Alkylated diphenylamine

[4]Detergent is overbased calcium alkylbenzene sulfonic acid

[5]The additional additives used in the examples include dispersants, a viscosity modifier, ashless friction modifiers, and an antifoam agent, and include some amount of diluent oil. The same additive package is used in each of the examples.

Testing

The lubricating oil composition examples summarized in Table 1 are evaluated for both oxidative resistance as well as resistance to lead corrosion (Table 2) in the presence of biodiesel. Corrosion resistance is evaluated by addition of soya methyl ester (SME) (5 weight %) to the lubricating compositions and carrying out ASTM D6594, the standard test method for evaluation of corrosiveness of diesel engine oil. Oxidative stability is evaluated by pressure differential scanning calorimetry (PDSC), using industry standard test CECL85 for oxidation induction time. In this test, a sample is measured into a cell which is pressurized with air to 690 kPa (100 psi) and maintained at 210° C. until an oxidation event is detected by heat flow. The oxidation induction time, in minutes, is reported. Longer times are better.

TABLE 2

| Oxidation and Corrosion Testing | | | | | | | | |
|---|---|---|---|---|---|---|---|---|
| | COMP EX1 | COMP EX2 | COMP EX3 | INV EX4 | INV EX5 | INV EX6 | INV EX7 | INV EX8 |
| PDSC Oxidation onset time (min) | 82 | 98 | 122 | 121 | 113 | 138 | 112 | * |
| Lead (ppm) | 1682 | 1528 | 1877 | 941 | 593 | 1037 | 1136 | 411 |

* Not determined

The results show that conventional antioxidants are able to provide the desired oxidative stability, but the lead corrosion is very high. Addition of supplemental phenolic antioxidant (EX2) or 4,4'-coupled bisphenol (EX3) shows a slight improvement in lead corrosion. In contrast, addition of 0.5 w.t % of the 2,2'-coupled phenol resulted in markedly improved lead (Pb) corrosion with a small decrease in the oxidation induction time. At equal total antioxidant (EX5) with 2,2'-bisphenol resulted in both improved oxidation induction time as well as a 60% decrease in Pb corrosion. Likewise, the ethyl analog (EX6) and the material with methylcyclohexyl groups (EX7) also show improved Pb corrosion at comparable oxidation onset. Example 8, in which the disclosed additive is the sole antioxidant, provides very low lead corrosion.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl, and imidazolyl. Heteroatoms include sulfur, oxygen, and nitrogen. In general, no more than two, or no more than one, non-hydrocarbon substituent will be present for every ten carbon atoms in the group; alternatively, there may be no non-hydrocarbon substituents in the hydrocarbyl group.

Thus, a hydrocarbyl group which is substituted by an ester group will still be characterized as a hydrocarbyl group if the above characteristics are met. As an example, an ester-substituted hydrocarbyl group may be represented by the formula —RC(O)OR$^4$ where R is an alkylene group and R$^4$ is a $C_1$ to $C_{12}$ alkyl group, e.g., a $C_4$ to $C_8$ alkyl group; such a group may be considered a hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricating oil composition containing or contaminated with at least about 0.1 wt. % of a biodiesel fuel or a decomposition product thereof, based on the total weight of the lubricating oil composition, said lubricating composition further comprising an oil of lubricating viscosity and about 0.5 to about 5 weight percent of an antioxidant selected from the group consisting of 2,2'-Methylenebis[4-methyl-6-t-butylphenol], 2,2'-Methylenebis[4-ethyl-6-t-butylphenol], 2,2-Methylenebis[4-methyl-6-[α-methylcyclohexyl)phenol], and any combination thereof.

2. The lubricating oil composition of claim 1 wherein the amount of the alkylene-coupled phenol is about 0.1 to about 3 weight percent.

3. The lubricating oil composition of claim 1 wherein the composition further comprises at least one of detergents, dispersants, metal salts of organic phosphorus compounds, viscosity modifiers, and additional antioxidants.

4. The lubricating oil composition of claim 1 wherein the composition further comprises a metal-containing detergent.

5. The lubricating oil composition of claim 4 wherein the metal-containing detergent comprises an alkaline earth metal sulfonate, phenate, or salicylate.

6. The lubricating oil composition of claim 4 wherein the metal-containing detergent comprises an overbased calcium salicylate detergent.

7. The lubricating oil composition of claim 1 wherein the alkylene-coupled phenol antioxidant comprises at least about 67 percent by weight of the total amount of the ashless antioxidants of the composition.

8. The composition of claim 1 wherein the biodiesel fuel or a decomposition product thereof comprises a fatty acid alkyl ester.

9. The composition of claim 8 wherein the fatty acid alkyl ester is a methyl ester of a carboxylic acid having about 12 to about 24 carbon atoms and having at least one olefinic double bond.

10. A method for lubricating a diesel engine fueled with a liquid fuel containing at least about 2 percent by weight of a fatty acid alkyl ester, comprising supplying to said engine a lubricant comprising an oil of lubricating viscosity and about 0.5 to about 5 weight percent of an antioxidant selected from the group consisting of 2,2'-Methylenebis[4-methyl-6-t-butylphenol], 2,2'-Methylenebis[4-ethyl-6-t-butylphenol]2-Methylenebis[4-methyl-6-[α-methylcyclohexyl)phenol], and any combination thereof.

11. The method of claim 10 wherein the lubricant further comprises a metal-containing detergent.

12. The method of claim 11 wherein the metal-containing detergent comprises an alkaline earth metal sulfonate, phenate, or salicylate.

13. The method of claim 11 wherein the metal-containing detergent comprises an overbased calcium salicylate detergent.

14. The method of claim 10 wherein the alkylene-coupled phenol antioxidant comprises at least about 67 percent by weight of the total amount of the ashless antioxidants of the composition.

15. The method of claim 10 wherein the liquid fuel contains at least about 5 percent by weight of a fatty acid alkyl ester.

16. The method of claim 10 wherein the lubricant contains or is contaminated with at least about 0.1 wt. % of a biodiesel fuel or a decomposition product thereof.

* * * * *